United States Patent [19]

Tsuji

[11] Patent Number: 4,753,346

[45] Date of Patent: Jun. 28, 1988

[54] AUTOMOBILE-SHAPED CASE FOR DESK ACCESSORIES

[75] Inventor: Shintaro Tsuji, Tokyo, Japan

[73] Assignee: Sanrio Company, Ltd., Tokyo, Japan

[21] Appl. No.: 81,997

[22] Filed: Aug. 5, 1987

[30] Foreign Application Priority Data

Oct. 20, 1986 [JP] Japan ..... 61-160759[U]
Oct. 20, 1986 [JP] Japan ..... 61-160760[U]

[51] Int. Cl.[4] ..... B65D 85/28

[52] U.S. Cl. ..... 206/371; 206/224; 206/457; 446/75; 446/78; 446/471

[58] Field of Search ..... 206/223, 224, 371, 457; 446/75, 78, 465, 471, 470; 220/20, 22

[56] References Cited

U.S. PATENT DOCUMENTS

| | | | |
|---|---|---|---|
| D. 123,218 | 10/1940 | Stavenhagen | 206/457 |
| 10,114 | 5/1882 | Reed | 446/75 |
| 1,296,912 | 3/1919 | Blumenthal | 206/457 |
| 1,647,536 | 11/1927 | Miller | 206/457 |
| 1,756,048 | 4/1930 | Williams | 206/457 |
| 4,055,250 | 10/1977 | Mayhew | 206/457 |
| 4,120,118 | 10/1978 | Mathews et al. | 446/471 |
| 4,591,056 | 5/1986 | Groch | 446/471 |
| 4,678,451 | 7/1987 | Ventura | 446/471 |

FOREIGN PATENT DOCUMENTS

| | | | |
|---|---|---|---|
| 33039 | 2/1905 | France | 206/223 |

*Primary Examiner*—David T. Fidei
*Attorney, Agent, or Firm*—Owen, Wickersham & Erickson

[57] ABSTRACT

A model automobile-shaped case for desk appliances, comprising a lower half equipped with an automobile-like lower body portion and a plurality of wheels and an upper half having an automobile-like upper body portion having some windowpane-like surfaces. The halves are releasably combinable with each other with the aid of a locking mechanism for holding the two halves together. The lower half is formed with a space opening from the top for accepting some stationery accessories and provided with another space closable by a hood hingedly attached thereto for accepting other stationery accessories. The upper half is provided with closable recesses opening from the bottom for accepting further stationery accessories. A pair of writing instruments are mounted in openings at the front of the lower half to simulate headlights, and they are ejectable by forward movement of the wheels.

13 Claims, 4 Drawing Sheets

AUTOMOBILE-SHAPED CASE FOR DESK ACCESSORIES

FIELD OF THE INVENTION

The present invention relates to a case shaped like an automobile for storing desk accessories.

BACKGROUND OF THE INVENTION

Heretofore, cases for desk accessories such as pens, erasers, memorandum pads, adhesive tape, measuring tape, scissors and the like have generally had a rectangular shape, sometimes being formed with recesses for each of the encased accessories to fit in.

There have been some novelty cases for housing such articles, but generally they have differed only in outer appearance.

An object of the present invention is to provide a model automobile-shaped case for housing desk accessories. The case is attractive, is easy to handle, has intriguing mechanical features, and can be displayed as an ornament with an aesthetic value ascribed to the shape of the body.

Another object is to provide a novel case having various mechanical arrangements for making its contained accessories accessible.

SUMMARY OF THE INVENTION

The case for desk accessories according to the present invention is a model automobile-shaped case. Its body has a pair of longitudinal bores, each of which is open at one of the two headlight positions for accepting a pair of writing utensils, such as ball-point pens or the like. It has four wheels pivotally or rotatably mounted on the body with such an arrangement that the treads of two of the wheels, normally the front wheels, come into contact with the writing utensils inserted from outside into the longitudinal bores, and rotation of those wheels projects or retracts the writing utensils.

The automobile-shaped case is divisible into a lower half equipped with the wheels and an upper half having windowpane-like surfaces. The two halves are releasably combinable with each other by means of a releasable locking engagement. The lower half is formed with an interior space for accepting such items as a memo pad and the like and is provided with a hood hingedly attached thereto for accepting, into a simulated engine compartment, items such as an eraser and brush combination held by what looks like an automotive engine. The lower half comprises a number of different major portions, including a body portion and a chassis. The upper half is invertible when taken off and is provided with recesses for further different items, such as a measuring tape unit that looks like a spare tire, a stapler and the like, to fit therein. Further items are accessible from outside and act to provide a paper clip that looks like a license plate and a pair of scissors part of which serves as a rear bumper for the car. Storage for a ruler is provided in the lower surface of the car's lower half.

Further objects and advantages of the invention will appear from the drawings and detailed description below.

DESCRIPTION OF A PREFERRED EMBODIMENT

Figure 1:
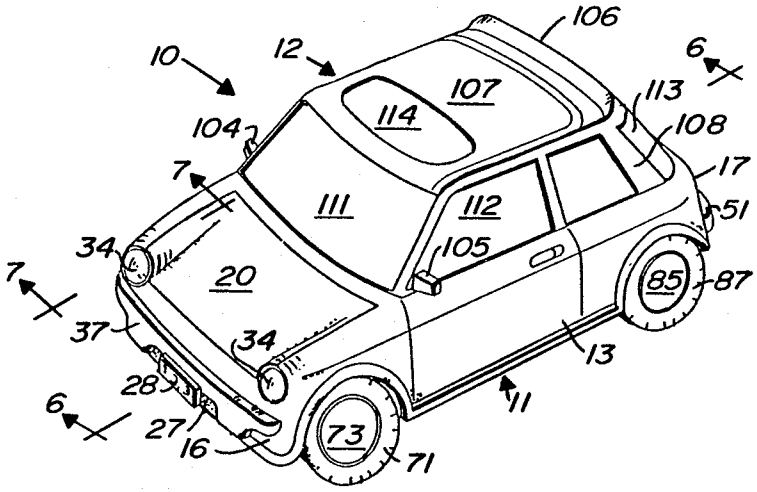
FIG. 1 is a view in perspective of the case for desk accessories, embodying the principles of the invention.

In the embodiment shown in the drawings, an automobile-like body 10 is divisible into two halves, i.e., a lower half 11 and an upper half 12. The entire "car" may lie within a space of about 6"×3"×3", the upper half 12 of the body 10 being shorter, about 4" or less long and about 2½" wide.

The lower half 11 constitutes an assembly of several individual parts. The basic element of the lower half 11 is a molded plastic body portion 13 of the car, which, viewed exteriorly, provides a body shell 14 and a downwardly recessed accessory-holding cavity 15, which generally represents the interior or passenger compartment of an automobile, but contains nothing simulating seats, steering wheels, or things of that nature.

Figure 2:
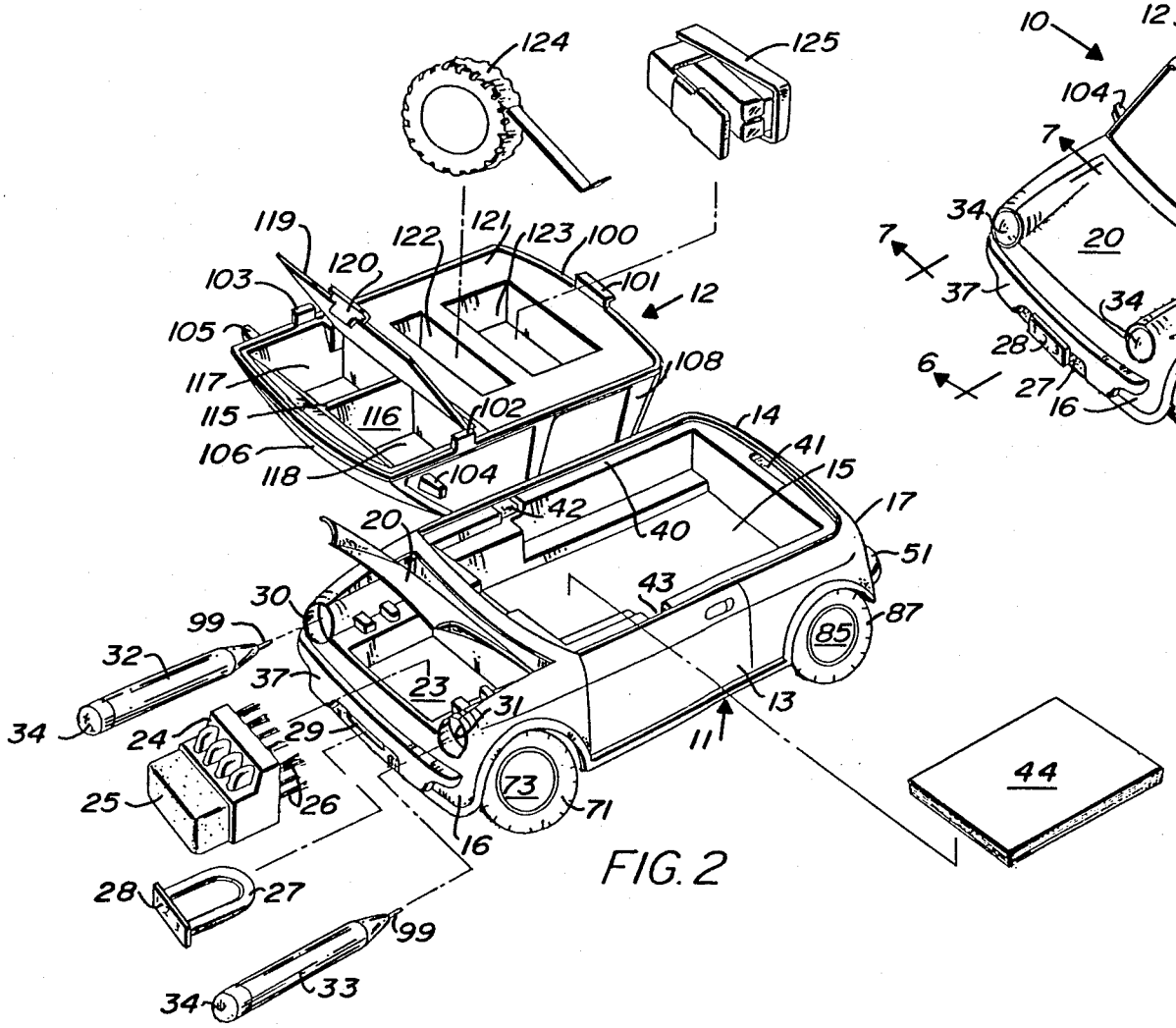
FIG. 2 is a partially exploded view in perspective of the car-like case of FIG. 1, looking from the front, and from above, with the upper body half inserted.

This lower body portion 13 has a front end 16 and a rear end 17. Just back of the front end 16 is mounted a pivoted hood 20, also molded from plastic, usually the same plastic as that from which the body portion 13 is molded. This hood 20 (See FIG. 6) is made with integral pivots 21 which are held by a couple of holding brackets 22 that are molded integrally into the body portion 13. Beneath the hood 20 is an "engine" compartment 23 (FIG. 2) which may contain a plastic member 24 which looks like an engine, but which acts as a holder for an eraser 25 at one end and a brush 26 at the other end. The eraser 25 and brush 26 may be used without removal from the engine-like holder, or they may be removed therefrom for replacement or use separately.

At the front end 16 of the car is a large paper clip 27 with a front transverse end 28 that looks like a license plate; it is removable from an opening 29 in the front end 16, in which it is held by friction.

Also, at the front end 16, the body portion 13 is provided with a pair of headlight openings 30 and 31 into which (as will be explained in more detail later) a pair of ball-point pens 32 and 33, each provided with a clear plastic outer end 34 that looks like a headlight lens. Below the openings 30 and 31 are a pair of small openings 35 and 36 (See FIG. 4) which are normally concealed by a part 37 which is molded, usually in black plastic, to resemble a front bumper and has pegs 38 and 39 fitting into the openings 35 and 36. The bumper 37 performs no particular function except as decoration and simulation. Below the bumper 37 is the rectangular slit-like opening 28 for the "license plate" paper clip 27.

The upper edge of the recess 15 corresponding to a passenger compartment is provided with a shelf 40 (FIG. 2) around its perimeter above, around, and outside of which extends the body shell 14. The shelf 40 is interrupted in four places, three of which constitute openings 41, 42, and 43 that go all the way through the shelf 40, one opening 41 at the rear and the other two openings 42 and 43 at the sides near the front of the recess 15.

In the main compartment 15 a memo pad 44 and other things may be retained, if desired.

At the rear end 17, the lower body portion 13 is provided with a pair of small openings 45 (FIG. 4) to receive pegs 46 that are part of the simulated taillights 47 and 48 which perform no particular function, so far as the desk accessories are concerned, but which do add to the life-likeness of the car. The rear end 17 is also provided with a long rectangular slot 50 to receive a pair of scissors 51 that will be described below.

Figure 4:
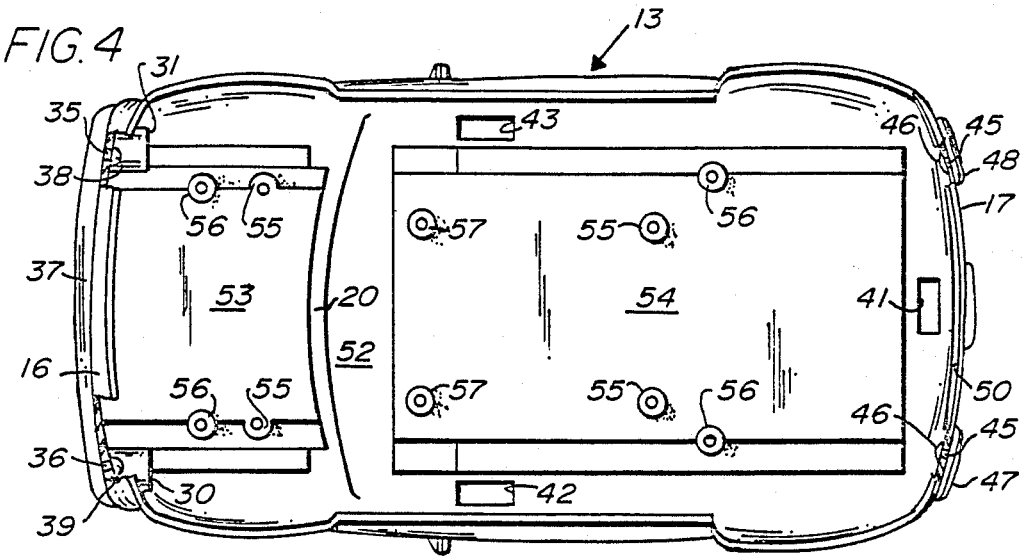
FIG. 4 is a bottom view of the lower body's molded plastic body portion.
Figure 7:
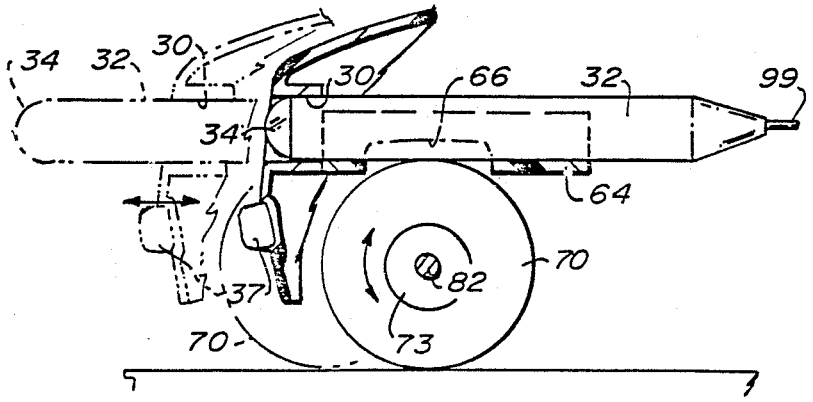
FIG. 7 is a fragmentary vertical side view in section taken along the line 7—7 in FIG. 1 of a front portion of the case. In broken lines is shown and advanced position, with the writing instrument projected out and forward.
Figure 5:
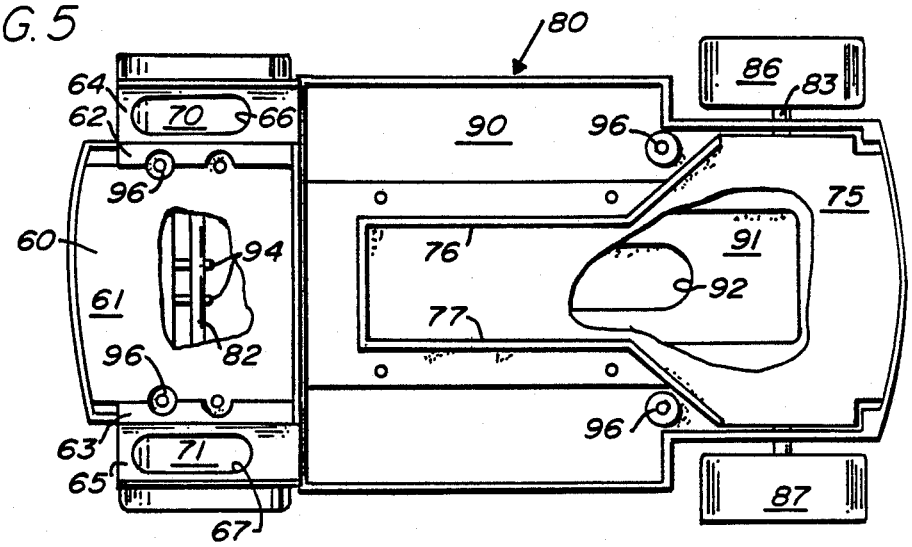
FIG. 5 is a top view of a lower portion of the lower body half, below the body shell, two portions broken away to show parts otherwise obscured.

As viewed from underneath, as in FIG. 4, the lower body portion 13 is relatively thin. Its lower surface 52 provides two major flat surface portions 53 and 54, each with a respective series of projecting screw receiving projections 55, 56 and 57 extending out therefrom, end to receive screws 58. At the front, underneath the "engine" compartment 23, the flat lower surface portion is provided with two projections 55 and two projections 56 to receive screws 58 and to align a member 60 (See FIG. 5) which, when set in place provides a flat central portion 61 held on the lower surface portion 53 and has two wings 62 and 63 that extend upwardly and outwardly and provide two half tubes 64 and 65, which (as shown in FIG. 7) help to support the ball-point pens 32 and 33 which are put into the headlight openings 30 and 31. Each of these half tubes 64 and 65, is provided with an extended opening 66 or 67 so that the automobile's "tires" 70 and 71 for the front wheels 72 and 73 can engage the pens 32 and 33 and help to project or retract these ball-point pens 32 and 33.

A plate 75, which lies to the rear of the member 60 (See FIGS. 5 and 6) is provided underneath the central flat portion 54 of the lower body portion 13. This plate 75 helps to retain the scissors 51, when they are inserted through the rear slit opening 50, having a pair of blade guides 76 and 77. The plate 75 is held to the portion 54 with four screws 58.

A major portion of the lower half assembly 11 is an automobile chassis-like portion 80 which provides four axle openings 81 in two pairs, through which a pair of axles 82 and 83 can extend, on each end of which are mounted wheels with rubber tires that look like automobile tires. The front wheels 72 and 73 and their tires 70 and 71 are used to project or retract the pens 32 and 33, and they and the rear wheels 84 and 85 and their tires 86 and 87 are also used to enable the automobile to be moved back and forth along a desk surface. Two of the four wheels which may be rather permanently secured to their axle 82 or 83, and the other two have a slip-fit therewith.

Figure 3:
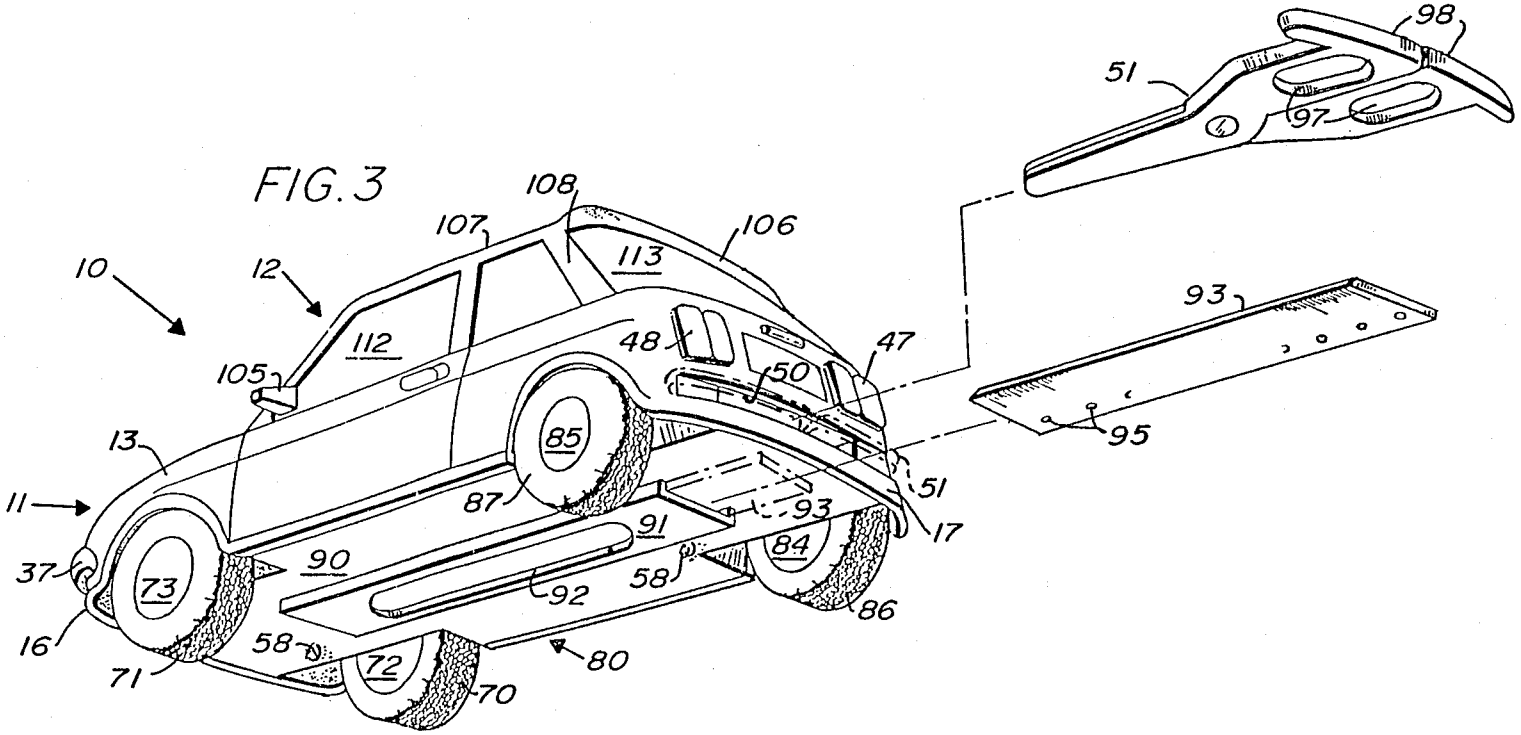
FIG. 3 is a partially exploded view in perspective looking from the rear and from below.
Figure 6:
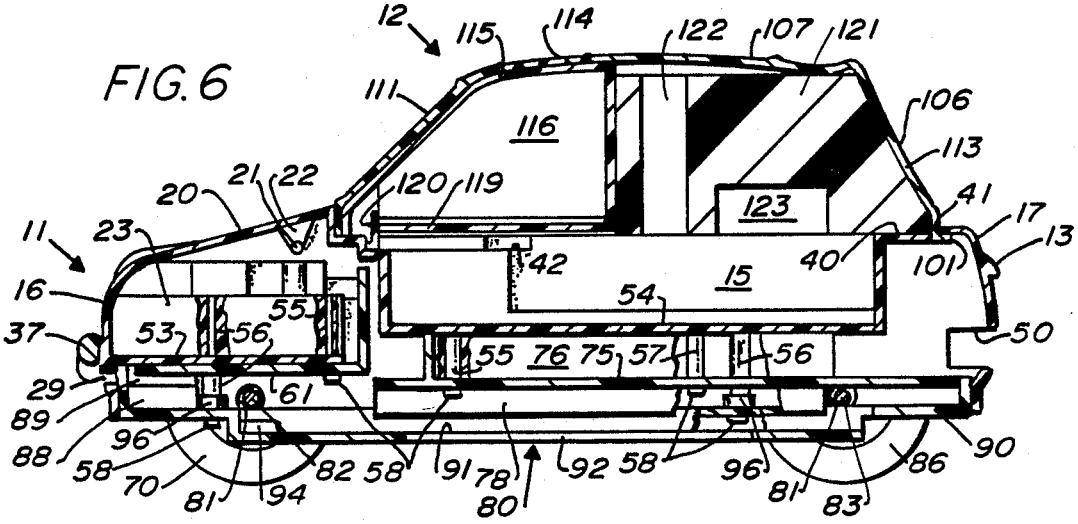
FIG. 6 is a view in section of the case taken along the line 6—6 in FIG. 1, with most of the accessories removed.

The chassis 80 has a plate 90 (FIGS. 3, 5, and 6) provided with a central lengthwise depression 91 and having a bottom opening 92, which may be a long slit with oval ends, and spacing at the rear for the plate 75 provides for insertion and removal of a ruler 93 (FIG. 3). The central opening 92 enabling finger contact to help move the ruler 93 out. The front end of the ruler 93 normally engages stop members 94, which limit its movement inwardly so that it will not be projected too far inward and make it more difficult to retract the ruler 93. In addition, the plate 75 has a pair of depending members 78 that help to retain the ruler in place (FIG. 6). The ruler 93 may simply a typical little ruler, but it may be provided, at one centimeter or other spacings, with openings 95 that are tapered from the top down to permit marking with a ball-point pen 32 or 33 at the one-centimeter intervals.

The chassis 80 has four post-like members 96 (FIGS. 5 and 6) which are used in combination with the screws 58 to secure the chassis 80 to the body member 13. There are also some upwardly extending strips 88 at the front end 16 for support of the license-plate-like paper clip 27, and, parallel to the strips 88, taller spacer strips 89.

When the chassis 80 is in place, the ruler 93 may be slid in from the rear. Above that, with the aid of the slit-like opening 50 at the rear of the body, and the upper support plate 75, the scissors 51 may be installed. When installed, as in FIG. 1, they look like a rear bumper and add to the ornamental feature, and when taken out (FIG. 3) they provide a pair of scissors with finger openings 97. Wide bottom members 98 that simulate the rear bumper also provide the lower edge of the scissors 51. The scissors 51 are otherwise normal and and the blades are supported by the walls 76 and 77 of the plate 75.

The pair of short ball-point pens 32 and 33 may be installed by hand and look like a pair of headlights. The writing point 99 (FIG. 2 and 7) of each pair lies inwardly. When the lower body 11 is assembled, movement of the front wheels 72 and 73 forwardly acts to project both these pens 32 and 33, which may have the same or different colored inks in them, and if they are not all the way retracted but are partially inserted, the wheels 72 and 73 can be used retract them into their regular position.

The upper body half 12 has a peripheral lower rim 100 (FIG. 2) which is flat, except to provide a rear projection 101 and two side downward projections 102 and 103. Each of these projections goes first down and then out to the rear or side. These three projections 101, 102 and 103 are used to hold the complete body 10 together. That is, the rear projection 101 is inserted into the opening 41 in the shelf 40 and its lower end projects back toward the rear end 17 of the body shell 14 and then acts as a kind of pivot. When the upper half 12 is rotated around by this pivotal action, the two side members 102 and 103 come down into the openings 42 and 43 at the sides of the shelf 40 and engage there, performing an easily opened but suitably locking system. Disassembly is achieved preferably by pushing up on a pair of members 104 and 105 (FIGS. 1 and 2), each simulating rear-view mirrors at each side of the upper half 12. The upper body member 12 will then pivot on the rear projecting member 101 until it is opened sufficiently so that by a slight forward movement the upper body half 12 can be detached for the lower body half 11.

The upper body half 12 has a shell 105 defining a top 107 and the upper portion 108 of the body 10. Portions are preferably made black or reflecting to look like glass, providing (See FIG. 1) a windshield 111, side windows 112 and a rear window 113. There may be a window-like opening 114 which may be clear or opaque in the top 107 to simulate a sun roof. Inside this shell 106, the assembly is completed by insertion of two major members: one is a pivoted preferably clear plastic shaped receptacle 115 (FIGS. 2 and 6), which may have a divider 116 to provide two compartments 117 and 118, lying beneath the sun roof window 114 and may have a hinged bottom lid 119 with a latch 120. This may be used for retaining paper clips or other desk accessories.

To the rear of the receptacle a foam member 121 is inserted (FIGS. 2 and 6) to provide two pockets 122 and 123; a forward one 122 which is rectangular and extends toward each side, and serves to retain a measuring tape 124. The tape 124 may resemble a spare tire in appearance and add to the general illusion. The rear pocket 123 may be somewhat bigger and not as deep, and may hold a tiny stapler 125.

When the automobile-shaped body 10 is pushed forward by one hand on a desk surface, etc., the rubber-tired front wheels 22 and 23 rotate and protrude the ball-point pens 32 and 33 forward; they are then readily drawn out manually. Returning of the pens 32 and 33 to the body tubes 15 may be done by simply inserting them into the tubes 15. If they have not been fully inserted, they may be drawn back in by reversing the direction of rotation of the wheels 72 and 73.

Since the case of the present invention is formed in the shape of a model automobile, it is of ornamental value when placed on a desk. Further writing utensils and accessories can be entirely housed in the case 10.

To those skilled in the art to which this invention relates, many changes in construction and widely differing embodiments and applications of the invention will suggest themselves without departing from the spirit and scope of the invention. The disclosures and the descriptions herein are purely illustrative and are not intended to be in any sense limiting.

What is claimed is:

1. A model automobile-shaped case for desk appliances, comprising a case shaped as an automobile body having a pair of open longitudinal bores at headlight positions, a pair of ball-point pens each having a convex head at one end and a writing point at the other end inserted loosely into said bores, said case providing pen-supporting members to the rear of said bores, and a pair of front wheels having tread surfaces rotatably mounted on said body in an arrangement such that the treads of the wheels engage the pens so that when the wheels are rotated in the direction of forward movement of the automobile, they cause the pens to move longitudinally out from said bores.

2. A case for stationery accessories and the like comprising:

an assembly shaped and decorated to look like a mainature automobile and having a lower body half and an upper body half joined together separably by releasable latch means, said lower body half having a body shell member providing an automobile-like outside surface with an upwardly facing downwardly extending recess corresponding in location to an automobile passenger compartment for holding stationery accessories, and a second recess corresponding in location to an engine compartment and provided there with a pivoted hood-like member, said body shell molding also having a pair of headlight-like receiving openings at the front end and a scissors-receiving opening at the rear end, said body shell member also having a lower surface having a forward flat area and a rear flat area and a multiplicity of downwardly projecting columns that are provided with interiorly threaded vertical bores, a series of screws to fit into said threaded bores, a pair of ball-point pens shaped to fit into said headlight-like openings and to provide simulated headlights there, a pair of scissors extending into said body shell member from the rear and having a rear portion that then simulates a rear bumper, a forward plate member fitting against said forward flat area and guided into position by some of said columns and secured there by some of said screws, said forward member having a pair of wings extending outwardly and to the sides and having semi-tubular portions, each for supporting one said ball-point pen that lies in a said headlight-like opening at each side, each semi-tubular portion having an opening therethrough, a rear plate abutting said rear flat area and secured to said body shell molding by some of said screws, and having a scissors receiving and supporting portion with blade guiding walls on the upper face thereof, a chassis portion with a pair of wheel-carrying axles and a central portion abutting said rear plate and secured thereto and to said body shell member by some of said screws, the front wheels when installed extending up into the openings through said semi-tubular portions for engagement with the ball-point pens for projecting them outwardly or inwardly when said wheels are moved, said upper body half having an exterior shell portion simulating the upper portion of an automobile with windshield, rear window, and side windows and a top, said upper body half having a recess in said shell and means therein for carrying stationery accessories.

3. The case of claim 2 wherein said upper body half has a pair of members simulating rearview mirrors mounted one on each side of the body to serve as handles for separating said upper and lower body halves.

4. The case of claim 2 having an engine-simulating plastic member in said hood portion of said lower body half holding an eraser and a brush.

5. The case of claim 2 containing in said upper body half recess a measuring tape simulating the appearance of a spare tire for said automobile.

6. A case for stationery accessories and the like comprising:

an assembly shaped and decorated to look like a miniature automobile and having a lower body half and an upper body half joined together separably, said lower body half having a body shell member providing an automobile-like outside surface and an upwardly facing downwardly extending recess corresponding in location to an automobile passenger compartment for holding stationery accessories, said recess having therearound an interior shelf having a horizontally extending rear through opening and two horizontally extending side through openings, all surrounded by a body shell portion, said upper body half having a bottom planar rim with a rear projection extending downwardly to a terminal horizontal latch portion that extends rearwardly, and is adapted to fit into said rear through opening and act pivotally and two side projections projecting downwardly, each with a terminal outwardly extending portion that extends into a said side opening and provides a releasable latch to said lower body half, said body shell member having a second recess corresponding in location to an engine compartment and being provided there with a pivoted hood-like member, an engine-simulating plastic member in said hood portion of said lower body half providing a holder for an eraser and a brush therein, said body shell member also having a pair of headlight-like receiving openings, a pair of ball-point pens shaped to fit into said headlight-like openings and to provide simulated headlights there, scissors extending into said body shell member from the rear end thereof, said scissors having a base portion at said rear end that simulates a rear bumper, said body shell member also having a lower surface with a forward flat area and a rear flat area and a multiplicity of downwardly projecting columns that are provided with interiorly threaded vertical bores, a series of screws fitting into said threaded bores, a forward plate member fitting against said forward flat area, guided into position there by some of said columns and secured there by some of said screws, said forward plate member having a pair of side wings extending upwardly and and having semi-tubular portions, each supporting one said ball-point pen when it lies in a said headlight-like opening, each semi-tubular portion having an opening therethrough, a rear plate abutting said rear flat area and secured to said body shell member by some of said screws, and having a scissors receiving portion with blade guiding walls on the upper face thereof for supporting said scissors inside said case, a chassis portion having two pairs of axle openings and a central portion abutting said rear plate and secured thereto and to said body shell member by some of said screws, a pair of axles, each with wheels on each end, providing a pair of front wheels and a pair of rear wheels, at least one of which for each axle is removable for insertion of said axle into said axle openings, said front wheels when installed extending up into said openings through said semi-tubular portions for engagement with the ball-point pens, so that the front wheels can project said ball-point pens outwardly or bring them back inside when said front wheels are moved, said upper body half having an exterior shell portion simulating the upper portion of an automobile with windshield, rear window mirror, and side windows and a top, said top having a clear portion simulating a sun roof, said upper body half having a recess in its said shell portion divided by a partition into a forward portion containing a tray-like member for carrying stationery accessories, and a rear portion including a foam member provided with a pair of recesses, a measuring tape fitting in one said recess of said pair and simulating the appearance of a spare tire for said automobile, and a small stapler unit fitting into the other said recess of said pair.

7. The case of claim 6 wherein said central portion of said chassis portion is provided with a horizontal support portion having a bottom opening therethrough and an end opening, and a ruler insertable in said end opening and resting on said support portion and contactable through said bottom opening to facilitate removal thereof.

8. The case of claim 7 having a paper clip providing at one end a license-plate member, said clip being insertable into said lower half body shell member at the front end thereof.

9. The case of claim 7 wherein said upper body member has a pair of handles forward of said side projections and extending outwardly to look like said-mounted rearview mirrors, for use in separating said upper and lower body halves.

10. The case of claim 8 having peg-mounted members on said lower body to simulate a front bumper and rear taillights.

11. A model automobile-shaped case for desk appliances, comprising a case shaped as an automobile body having a pair of open longitudinal bores at headlight positions, a pair of generally cylindrical writing instruments, each having a convex head at one end and a writing point at the other end, inserted loosely into said bores, said case providing retaining means for supporting said writing instruments to the rear of said bores, and a pair of front wheels having tread surfaces rotatably mounted on said body in an arrangement such that the treads of the wheels engage the writing instruments so that when the wheels are rotated in the direction of forward movement of the automobile, they cause the writing instruments to move longitudinally out from said bores.

12. The case of claim 11 wherein:

said lower body includes a shell member having a lower surface with a forward flat area, and a forward plate member fitting against and secured to said forward flat area and having a pair of wings extending outwardly and to the sides and having semi-tubular portions, each for supporting one said writing instrument that lies in a said longitudinal bore at each side, each semi-tubular portion having an opening therethrough, through which the front wheels engage said writing instruments.

13. The case of claim 11 having a pair of scissors extending into said lower body from the rear and having a pair of finger-receiving portions that have a rearmost portion that then simulates a rear bumper, said body having a flat lower surface area and a rear plate abutting and secured to said flat area and having a scissors-receiving-and-supporting portion with blade-guiding walls on the upper face thereof.

* * * * *